United States Patent [19]

Leonard

[11] 4,214,170

[45] Jul. 22, 1980

[54] POWER GENERATION-REFRIGERATION SYSTEM

[75] Inventor: Louis H. Leonard, Cranberry Lake, N.Y.

[73] Assignee: Carrier Corporation, Syracuse, N.Y.

[21] Appl. No.: 950,887

[22] Filed: Oct. 12, 1978

[51] Int. Cl.[2] ..... F02G 3/00

[52] U.S. Cl. ..... 290/1 R; 62/87

[58] Field of Search ..... 290/1, 2; 62/6, 53, 62/87, 88

[56] References Cited

U.S. PATENT DOCUMENTS

| | | | |
|---|---|---|---|
| 3,194,026 | 7/1965 | La Fleur | 62/88 |
| 3,367,111 | 2/1968 | Edgemond, Jr. et al. | 290/2 X |
| 3,921,400 | 11/1975 | Pitcher | 62/6 X |
| 3,992,891 | 11/1976 | Pocrnja | 62/87 X |
| 4,150,300 | 4/1979 | Van Winkle | 290/1 R X |

*Primary Examiner*—J. V. Truhe
*Assistant Examiner*—W. E. Duncanson, Jr.
*Attorney, Agent, or Firm*—J. Raymond Curtin; John S. Sensny

[57] ABSTRACT

A power generation-refrigeration system comprising a refrigerant boiler, and a primary turbine for extracting energy from the refrigerant. The system also comprises a reversible turbomachine having a compressor mode of operation for compressing refrigerant passing therethrough and a turbine mode of operation for extracting further energy from the refrigerant; a first flow path in communication with the primary turbine, the reversible turbomachine, and a condenser; a second flow path in communication with the primary turbine, the reversible turbomachine, the condenser, and an evaporator; and means for directing refrigerant through the first flow path when the reversible turbomachine is in the turbine mode and through the second flow path when the reversible turbomachine is in the compressor mode. Power means is provided for generating power, a first connecting means is provided for connecting the reversible turbomachine and the power means and having a power generation position wherein energy extracted from refrigerant by the reversible turbomachine is used to generate power; and a second connecting means is provided for connecting the primary turbine and the reversible turbomachine and having a refrigeration position wherein energy extracted from refrigerant by the primary turbine is transmitted to the reversible turbomachine to compress refrigerant passing therethrough, and a power generation position wherein energy extracted from the refrigerant by the primary turbine is transmitted to the reversible turbomachine to assist the generation of the power.

8 Claims, 1 Drawing Figure

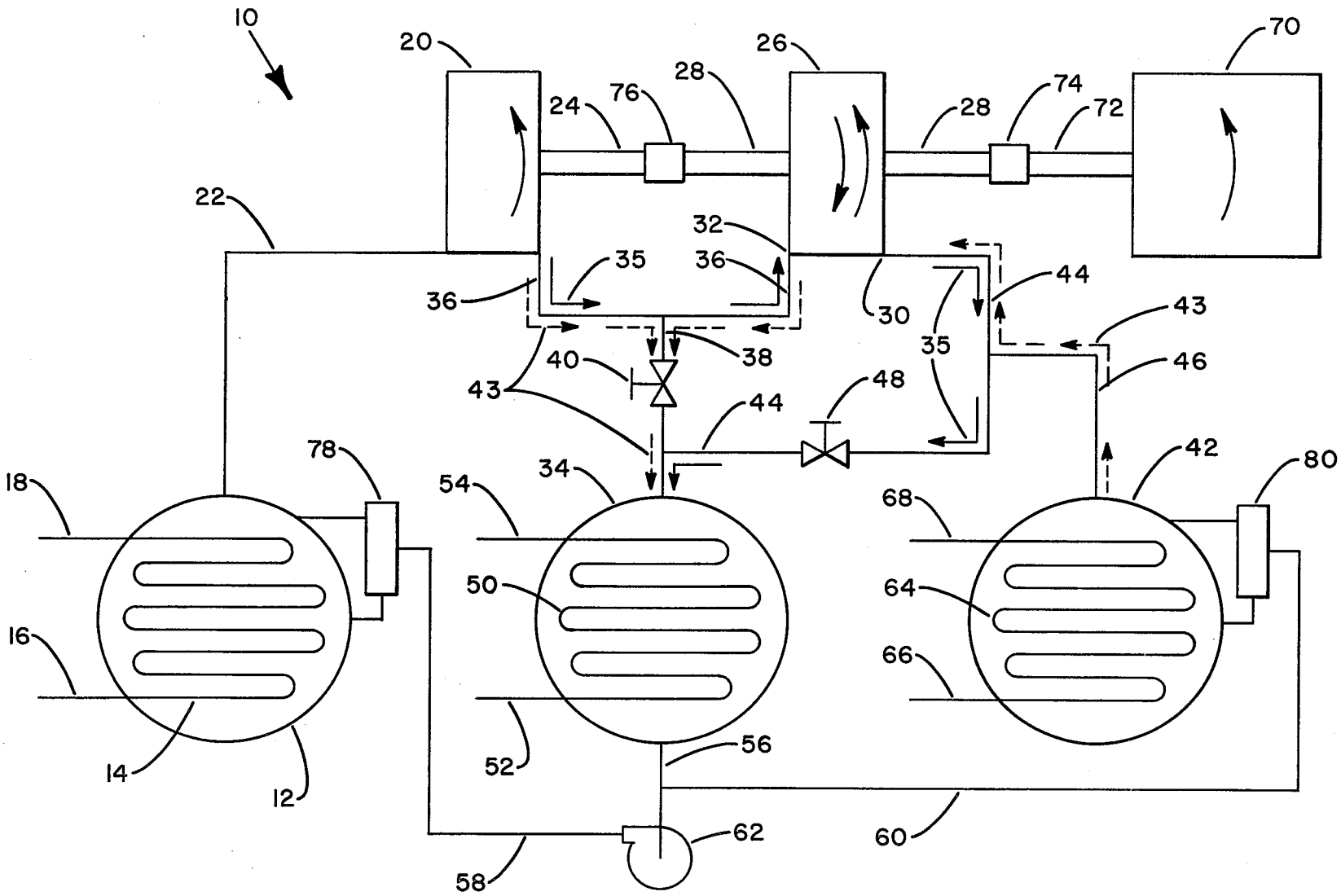
10
12
14
16
18
20
22
24
26
28
28
30
32
34
35
35
36
36
38
40
42
43
43
44
44
46
48
50
52
54
56
58
60
62
64
66
68
70
72
74
76
78
80

POWER GENERATION-REFRIGERATION SYSTEM

BACKGROUND OF THE INVENTION

This invention relates to a power generation-refrigeration system, and more particularly to a power generation-refrigeration system which is well adapted to use low temperature energy to selectively produce refrigeration or power.

With the increasing costs and decreasing availability of conventional fuel sources, more and more attention is being directed toward using energy such as low temperature energy which has heretofore often not been used. Low temperature energy may be available, for example, in the form of solar or geothermal heated hot water or steam, or as the waste heat produced by many manufacturing processes. These types of heat sources are usually at a relatively low temperature—a temperature at which it is difficult to use the heat for practical purposes. In accordance with the present invention, a unique power generation-refrigeration system, including a novel use of a reversible turbomachine and a plurality of novel fluid flow paths, is provided which is well adapted to use low temperature energy to selectively produce refrigeration or power.

Moreover, the system of the present invention can provide both power and refrigeration while using only one condenser. The size and cost of such a system, compared with the combined cost and size of two separate systems, one of which provides refrigeration and uses a first condenser, and the second of which provide power and uses a second condenser, is less, producing increased flexibility, compactness, and savings.

SUMMARY OF THE INVENTION

An object of the invention is to transform low temperature energy into a form in which its practical usefulness is significantly increased.

Another object of the present invention is to use low temperature energy to selectively produce a refrigeration effect or to generate electric power.

A further object of this invention is to employ a common working medium in both the power generation mode and the refrigeration mode of a power generation-refrigeration system.

A still further object of the present invention is to provide a method for operating an integrated power generation-refrigeration system wherein low temperature heat is used to selectively produce either electric power or a refrigeration effect.

Another object of this invention is to provide a power generation-refrigeration system which is particularly well suited for use with unreliable or unpredictable low temperature energy sources.

These and other objectives are attained with a power generation-refrigeration system comprising a refrigerant boiler for transferring heat from a source thereof to a refrigerant, and a primary turbine for extracting kinetic energy from the heated refrigerant. The system also comprises a reversible turbomachine having a compressor mode of operation for compressing refrigerant passing therethrough and a turbine mode of operation for extracting further kinetic energy from the heated refrigerant, a condenser for condensing the refrigerant, and an evaporator for transferring heat from a heat transfer medium to the refrigerant to cool the heat transfer medium and evaporate the refrigerant. The power generation-refrigeration system further comprises a first flow path in communication with the primary turbine, the reversible turbomachine, and the condenser for passing refrigerant therebetween; a second flow path in communication with the primary turbine, the reversible turbomachine, the condenser, and the evaporator for passing refrigerant therebetween; and means for directing refrigerant through the first flow path when the reversible turbomachine is in the turbine mode of operation and through the second flow path when the reversible turbomachine is in the compressor mode. Power means is provided for generating power; a first connecting means is provided for connecting the reversible turbomachine and the power means and having a power generation position wherein energy extracted from the refrigerant by the reversible turbomachine is used to generate power; and a second connecting means is provided for connecting the primary turbine and the reversible turbomachine and having a refrigeration position wherein energy extracted from the refrigerant by the primary turbine is transmitted to the reversible turbomachine to compress refrigerant passing therethrough, and a power generation position wherein energy extracted from the refrigerant by the primary turbine is transmitted to the reversible turbomachine to assist the generation of power.

BRIEF DESCRIPTION OF THE DRAWING

The single FIGURE is a schematic representation of a power generation-refrigeration system constructed according to the present invention.

DETAILED DESCRIPTION OF THE PREFERRED EMBODIMENT

Referring to the drawing, there is depicted power generation-refrigeration system 10 constructed according to the present invention. System 10 comprises means such as refrigerant boiler 12 for transferring heat from a source thereof (not shown) to a refrigerant. The heat source may be any suitable source but, as explained subsequently, system 10 is well adapted for use with low temperature heat, for example solar heated water or the heat produced by many manufacturing processes, and so preferably the heat source is a source of low temperature heat. Heat transfer coil 14 is positioned in boiler 12 in heat transfer relationship with refrigerant flowing therethrough. A heat transfer fluid flows from the heat source, through fluid line 16, which connects heat transfer coil 14 with the heat source, and through the heat transfer coil. As it passes through heat transfer coil 14, the heat transfer fluid rejects heat to the refrigerant flowing through boiler 12. The heat transfer fluid passes into fluid line 18, and from there the fluid may be discharged or may be returned to the heat source for reuse. Refrigerant in boiler 12 evaporates or boils as it absorbs heat from the fluid passing through coil 14, and vaporous refrigerant passes from the refrigerant boiler through conduit 22 to means such as primary turbine 20 for extracting kinetic energy from the heated refrigerant. Rotatable shaft 24 is positioned partly inside primary turbine 20 and, in a manner well known in the art, passage of refrigerant vapor through the primary turbine causes rotation of the turbine shaft.

Power generation-refrigeration system 10 also comprises reversible turbomachine 26. Reversible turbomachine 26 has a compressor mode of operation for compressing refrigerant passing therethrough and a turbine expansion mode of operation for extracting further kinetic energy from the heated refrigerant. More specifically, reversible turbomachine 26 includes shaft 28, a plurality of stator blades (not shown) secured to a casing of the reversible turbomachine, and a plurality of rotor blades (not shown) mounted on shaft 28 for rotation within the casing. As is known in the art, shaft 28, the casing, and the stator and rotor blades cooperate so that, when the reversible turbomachine is in the compressor mode of operation, refrigerant passing therethrough is compressed by rotation of shaft 28 and, when the reversible turbomachine is in the turbine mode of operation, refrigerant passing therethrough is expanded to rotate shaft 28. Referring particularly to the drawing, when reversible turbomachine 26 is in the compressor mode of operation, refrigerant enters the turbomachine at point 30, passes therethrough, is compressed thereby, and exits at point 32. On the other hand, when reversible turbomachine 26 is in the turbine mode of operation, refrigerant enters the turbomachine at point 32, passes therethrough, causes rotation of shaft 28, and exits at point 30.

System 10 further comprises condenser 34 for condensing refrigerant, and evaporator 42 for transferring heat from a heat transfer medium to the refrigerant to cool the heat transfer medium and evaporate the refrigerant. A first flow path, shown generally in the drawing with full line arrows and designated as 35, is in communication with primary turbine 20, reversible turbomachine 26, and condenser 34 for passing refrigerant therebetween; and a second flow path, shown generally in the drawing with broken line arrows and designated as 43, is in communication with the primary turbine, the reversible turbomachine, the condenser, and evaporator 42 for passing refrigerant therebetween. System 10 also comprises means such as valves 40 and 48 for directing refrigerant through first flow path 35 when reversible turbomachine 26 is in the turbine mode and through second flow path 43 when the reversible turbomachine is in the compressor mode.

More specifically, first and second flow paths 35 and 43 include first conduit or fluid line 36 in communication with primary turbine 20 and reversible turbomachine 26 for passing refrigerant therebetween, second conduit or fluid line 38 in communication with conduit 36 and condenser 34 for passing refrigerant therebetween, third conduit or fluid line 44 in communication with the reversible turbomachine and the condenser for passing refrigerant therebetween, and a fourth conduit or fluid line 46 in communication with conduit 44 and evaporator 42 for passing refrigerant therebetween. Preferably, as shown in the drawing, conduit 44 communicates indirectly with condenser 34 via line 38, eliminating the necessity for making a separate connection between the condenser and conduit 44. It will be apparent to one skilled in the art, however, that conduit 44 can be directly connected to condenser 34.

Valve 40 is located in conduit 38 and has an open position wherein refrigerant passes from primary turbine 20 and reversible turbomachine 26 to condenser 34, and a closed position wherein refrigerant passes from the primary turbine to the reversible turbomachine. More particularly, when valve 40 is open, vaporous refrigerant passes from primary turbine 20 through conduits 36 and 38 to condenser 34 and, at the same time, vaporous refrigerant exiting reversible turbomachine 26 at point 32 also passes to condenser 34 through conduits 36 and 38. However, when valve 40 is closed, refrigerant cannot pass through conduit 38 to condenser 34, and refrigerant discharged from primary turbine 20 passes through conduit 36 to reversible turbomachine 26, entering the reversible turbomachine at point 32. Valve 40 is maintained in the open position when system 10 is utilized to produce a refrigeration effect, and valve 40 is maintained in the closed position when system 10 is used to generate power. Valve 48 is located in conduit 44 and has an open position wherein refrigerant passes from reversible means 26 to condenser 34, and a closed position wherein refrigerant passes from evaporator 42 to the reversible turbomachine. More particularly, when valve 48 is open, vaporous refrigerant passes from reversible turbo means 26 through conduit 44 to condenser 34; and, when valve 48 is closed, vaporous refrigerant passes from evaporator 42 through conduits 46 and 44 to the reversible turbomachine, entering the turbomachine at point 30. Valve 48 is maintained in the open position when system 10 is utilized to produce power, and valve 48 is maintained in the closed position when system 10 is used to produce a refrigeration effect.

Heat transfer coil 50 is located in condenser 34. Coil 50 is connected to a source (not shown) of a cooling fluid such as a conventional water cooling tower, and the cooling fluid is passed therebetween via fluid lines 52 and 54. The cooling fluid absorbs heat from vaporous refrigerant flowing through condenser 34, condensing the refrigerant. Condensed refrigerant flows out of condenser 34 through fluid line 56 and into fluid lines or conduits 58 and 60. Line 58 is in communication with condenser 34 and refrigerant boiler 12 for passing refrigerant therebetween, and line 60 is in communication with the condenser and evaporator 42 for passing refrigerant therebetween. Pump 62 is located in communication with line 58 to pump refrigerant through line 58 to refrigerant boiler 12, and refrigerant passes through line 58 from condenser 34 to boiler 12 regardless of the mode of operation of system 10. In contrast, whether refrigerant passes through line 60 from condenser 34 to evaporator 42 depends on the mode of operation of system 10. Particularly, as discussed in greater detail below, when system 10 operates in a refrigeration mode, the vapor pressure in condenser 34 is greater than the vapor pressure in evaporator 42, and refrigerant naturally passes through conduit 60 from the condenser to the evaporator. But, when system 10 operates in a power generation mode, the vapor pressure in condenser 34 is less than the pressure in evaporator 42, preventing refrigerant from flowing through line 60 from the condenser to the evaporator.

Heat transfer coil 64, commonly referred to as a chilled water coil, is located in evaporator 42. Coil 64 is connected to a refrigeration load (not shown) by means of fluid lines 66 and 68, forming a closed loop fluid circuit, and a heat transfer medium such as water is passed through the circuit. The heat transfer medium absorbs heat from the refrigeration load and then passes through chilled water coil 64, rejecting heat to refrigerant flowing through evaporator 42 and evaporating the refrigerant.

In addition, system 10 comprises power means 70 for generating power, first connecting means 74 for connecting reversible turbomachine 26 and the power means, and second connecting means 76 for connecting primary turbine 20 and reversible turbomachine 26. First connecting means 74 has a power generation position wherein energy extracted from the refrigerant by reversible turbomachine 26 is transmitted to power means 70 to generate power. Second connecting means 76 has a refrigeration position wherein energy extracted from the refrigerant by primary turbine 20 is transmitted to reversible turbomachine 26 to compress refrigerant passing therethrough, and a power generation position wherein energy extracted from the refrigerant by the primary turbine is transmitted to the reversible turbomachine to assist the generation of the power.

Preferably, power means 70 includes shaft 72 wherein rotation of shaft 72 generates power, and even more advantageously, power means 70 includes an electric generator wherein rotation of shaft 72 generates electric power. Further, first connecting means 74 includes a first shaft coupling for connecting shaft 28 of reversible turbomachine 26 and shaft 72 of power means 70 and having a power generation position wherein rotation of shaft 28 rotates shaft 72 to generate power, and a neutral position wherein shaft 28 rotates independently of shaft 72. Second connecting means 76 includes a second shaft coupling for connecting shaft 24 of primary turbine 20 and shaft 28 of reversible turbomachine 26 and having a refrigeration position wherein shaft 24 rotates shaft 28 to compress refrigerant passing through the reversible turbomachine, and a power generation position wherein shaft 24 assists shaft 28 in rotating shaft 72 to generate power. Preferably, shafts 24 and 28 are co-axial and, when second shaft coupling 76 is in the refrigeration position, these two shafts rotate in opposite directions while, when the second shaft coupling is in the power generation position, these two shafts rotate in the same direction.

To better illustrate the manner in which power generation-refrigeration system 10 of the present invention functions, the system will be described in both the power generation mode and the refrigeration mode.

To generate power, specifically an electric current, valve 40 is closed, valve 48 is opened, first shaft coupling 74 is placed in the power generation position, and second shaft coupling 76 is placed in the power generation position. Refrigerant vapor flows from boiler 12 to primary turbine 20 and passes through the primary turbine, causing rotation of shaft 24. The expanded refrigerant then passes into line 36 and, because of closed valve 40, passes completely through line 36 and into reversible turbomachine 26. The refrigerant enters reversible turbomachine 26 at point 32, passes therethrough, and exits the reversible turbomachine at point 30. As explained above, when the refrigerant flows through turbomachine 26 in this manner, the reversible turbomachine functions in the turbine mode of operation, extracting further kinetic energy from the refrigerant vapor passing therethrough and transforming this additional kinetic energy into rotational energy of shaft 28. The rotational energy of shaft 24, developed in primary turbine 20, is transmitted to shaft 28 via second shaft coupling 76; and this energy, plus the rotational energy of shaft 28, developed in reversible turbomachine 26, is transmitted to shaft 72 via first shaft coupling 74, causing rotation of shaft 72. Rotation of shaft 72, in a manner well known to those skilled in the art, produces an electric current in generator 70.

As may be appreciated, since an electric current is easily transported and easily adapted to a variety of uses, the energy contained within an electric current has many practical advantages over the energy contained within waste heat. Thus, system 10 transforms low temperature energy into a form—an electric current—in which its practical usefulness is significantly increased. This makes system 10 well suited for use with low temperature energy. Furthermore, because the refrigerant vapor passes serially through primary turbine 20 and reversible turbomachine 26, the primary turbine and the reversible turbomachine cooperate to function as a two stage expander, first extracting energy from the refrigerant vapor at one temperature and pressure and then extracting energy from the vapor at a second temperature and pressure. Generally, such a two stage operation is more efficient than a single stage operation. This is another feature making system 10 particularly well suited for use with low temperature energy sources, which typically have a relatively small amount of extractable energy.

Refrigerant, after being discharged from reversible turbomachine 26 at point 30, passes through fluid line 44, through open valve 48, and into condenser 34. As explained above, the refrigerant is condensed in condenser 34 and the condensed refrigerant flows through line 56 and is pumped, via pump 62, through line 58 to boiler 12, where the refrigerant can begin another cycle. Fluid level control device 78 is located in line 58 to maintain the liquid refrigerant in boiler 12 at a constant level.

When refrigerant is condensed in condenser 34, the pressure and temperature of the refrigerant are decreased. This lower pressure causes a pressure difference to develop between condenser 34 and evaporator 42, causing the refrigerant vapor discharged from reversible turbomachine 26 at point 30 to naturally flow through fluid line 44 to the lower pressure condenser, as opposed to flowing through fluid lines 44 and 46 to the higher pressure evaporator. This pressure differential also prevents condensed refrigerant from flowing from condenser 34 to evaporator 42 by means of fluid line or conduit 60. Thus, check valves are not needed in lines 46 or 60 to prevent undesirable refrigerant flow therethrough, although such check valves may be provided.

To produce a refrigeration effect, valve 40 is opened, valve 48 is closed, first shaft couping 74 is positioned in the neutral position, and second shaft coupling 76 is positioned in the refrigeration position. Refrigerant vapor passes from boiler 12 to primary turbine 20 and flows through the primary turbine, causing rotation of shaft 24. With second shaft coupling 76 in the refrigeration position, rotation of shaft 24, as pointed out previously, causes shaft 28 of reversible turbomachine 26 to rotate and compress refrigerant passing therethrough. With first shaft coupling 74 in the neutral position, shaft 28 of reversible turbomachine 26 is free to rotate independent of shaft 72 of power means 70.

When reversible turbomachine 26 operates in the compressor mode of operation, the turbomachine draws refrigerant vapor from evaporator 42 through conduits or vapor lines 46 and 44, compresses the refrigerant vapor, and discharges the vapor at point 32. Refrigerant vapor discharged from reversible turbomachine 26 passes through conduits or fluid lines 36 and 38, through open valve 40, and into condenser 34; and, at the same time, the refrigerant vapor discharged from primary turbine 20 also passes through conduits or fluid lines 38 and 36, through open valve 40, and into condenser 34. The refrigerant vapor is condensed in condenser 34. Condensed refrigerant then flows through line 56 to lines 58 and 60. A portion of the condensed refrigerant is pumped through line 58, through control device 78 and into boiler 12, wherein the refrigerant absorbs more heat from the heat source. Condensed refrigerant also flows through line 60, through fluid level control device 80, and into evaporator 42. Fluid level control 80 maintains the liquid refrigerant in evaporator 42 at a predetermined level, and as the refrigerant flows through control device 80, the refrigerant expands and its temperature and pressure are lowered. The expanded refrigerant enters evaporator 42, absorbs heat from the heat transfer medium passing through heat transfer coil 64 thereby producing a refrigeration effect, is evaporated thereby, and is then drawn through fluid lines 46 and 44 and into reversible turbomachine 26. Closed valve 48 prevents refrigerant from passing from condenser 34 to evaporator 42 via conduit 44. Thus, it can be seen that system 10, when operating in a refrigeration mode, extracts energy from the energy source, and uses this energy to drive a vapor compression refrigeration cycle or circuit. This is accomplished by using only a single condenser and a single working fluid, eliminating the need for and cost of multiple condensers and multiple working fluids.

Power means 70 of power generation-refrigeration system 10 may include motor means, and first connecting means 74 may include a driving position wherein the motor means drives reversible turbomachine 26 to compress refrigerant passing therethrough. More particularly, power means 70 may include an electric induction generator having an electric generator mode of operation wherein rotation of shaft 72 in a first direction produces electric power, and an electric motor mode of operation for rotating shaft 72 in a second direction. Further, first shaft coupling 74, which connects shaft 72 of power means 70 with shaft 28 of reversible turbomachine 26, may include a driving position wherein rotation of shaft 72 in the second direction rotates shaft 28 to compress refrigerant passing through the reversible turbomachine. With this arrangement, when system 10 is operating in the refrigeration mode, if primary turbine 20 cannot drive reversible turbomachine 26 to satisfactorily compress the refrigerant flowing therethrough, then motor means 70 may be employed, either alone or in conjunction with the primary turbine, to drive the reversible turbomachine to insure that the refrigerant passing therethrough is adequately compressed. Such a situation might develop if, for example, the heat source used to boil refrigerant in boiler 12 was temporarily not available, or could supply only a very small amount of heat. More specifically, this might occur if the heat source was solar energy and system 10 was operating at night or during a period of extensive cloud cover. Under these or similar circumstances, electric induction generator 70, functioning as an electric motor, may be employed to rotate shaft 72, and first shaft coupling 74 may be placed in the driving position wherein rotation of shaft 72 rotates shaft 28 to compress refrigerant passing through reversible turbomachine 26. This feature of system 10, thus, makes this system especially well adapted for use with unreliable or unpredictable low temperature energy sources such as solar energy.

While it is apparent that the invention herein disclosed is well calculated to fulfill the objects above stated, it will be appreciated that numerous modifications and embodiments may be devised by those skilled in the art, and it is intended that the appended claims cover all such modifications and embodiments as fall within the true spirit and scope of the present invention.

What is claimed is:

1. A power generation-refrigeration system comprising:

first means for transferring heat from a source thereof to a refrigerant;

first means for extracting kinetic energy from the heated refrigerant;

means for passing refrigerant between the first heat transferring means and the first means for extracting kinetic energy;

a reversible turbomachine having a compressor mode of operation for compressing refrigerant passing therethrough and a turbine mode of operation for extracting further kinetic energy from the heated refrigerant;

a condenser for condensing the refrigerant;

means for passing refrigerant between the condenser and the first heat transferring means;

an evaporator for transferring heat from a heat transfer medium to the refrigerant to cool the heat transfer medium and evaporate the refrigerant;

a first flow path in communication with the first means for extracting kinetic energy, the reversible turbomachine, and the condenser for passing refrigerant therebetween;

a second flow path in communication with the first means for extracting kinetic energy, the reversible turbomachine, the condenser, and the evaporator for passing refrigerant therebetween;

means for directing refrigerant through the first flow path when the reversible turbomachine is in the turbine mode and through the second flow path when the reversible turbomachine is in the compressor mode;

power means for generating power;

first connecting means for connecting the reversible turbomachine and the power means and having a power generation position wherein energy extracted from the refrigerant by the reversible turbomachine is transmitted to the power means to generate power; and second connecting means for connecting the first means for extracting kinetic energy and the reversible turbomachine and having a refrigeration position wherein energy extracted from the refrigerant by the first means for extracting kinetic energy is transmitted to the reversible turbomachine to compress refrigerant passing therethrough, and a power generation position wherein energy extracted from the refrigerant by the first means for extracting kinetic energy is transmitted to the reversible turbomachine to assist the generation of the power.

2. The invention as described in claim 1 wherein:

the first and second flow paths include a first conduit in communication with the first means for extracting kinetic energy and the reversible turbomachine for passing refrigerant therebetween, a second conduit in communication with the first conduit and the condenser for passing refrigerant therebetween, a third conduit in communication with the reversible turbomachine and the condenser for passing refrigerant therebetween, and a fourth conduit in communication with the third conduit and the evaporator for passing refrigerant therebetween; and the means for directing refrigerant includes a first valve located in the second conduit and having an open position wherein refrigerant passes from the first means for extracting kinetic energy and the reversible turbomachine to the condenser, and a closed position wherein refrigerant passes from the first means for extracting kinetic energy to the reversible turbomachine, and a second valve located in the third conduit and having an open position wherein refrigerant passes from the reversible turbomachine to the condenser, and a closed position wherein refrigerant passes from the evaporator to the reversible turbomachine.

3. The invention as described in claim 2 wherein:

the first means for extracting kinetic energy from the heated refrigerant includes a primary turbine having a first shaft rotated by the passage of refrigerant through the primary turbine;

the reversible turbomachine includes a second shaft wherein, when the reversible turbomachine is in the compressor mode of operation, refrigerant passing therethrough is compressed by rotation of the second shaft and, when the reversible turbomachine is in the turbine mode of operation, refrigerant passing therethrough rotates the second shaft;

the power means includes a third shaft wherein rotation of the third shaft generates power;

the first connecting means includes a first shaft coupling for connecting the second shaft and the third shaft and having a power generation position wherein rotation of the second shaft rotates the third shaft to generate power, and a neutral position wherein the second shaft rotates independently of the third shaft; and the second connecting means includes a second shaft coupling for connecting the first shaft and the second shaft and having a refrigeration position wherein the first shaft rotates the second shaft to compress refrigerant passing through the reversible turbomachine, and a power generation position wherein the first shaft assists the second shaft in rotating the third shaft to generate power.

4. The invention as described in claim 3 wherein the power means includes an electric generator wherein rotation of the third shaft produces electric power.

5. The invention as described in claim 3 wherein:

the power means includes an electric induction generator having an electric generator mode of operation wherein rotation of the third shaft in a first direction produces electric power, and an electric motor mode of operation for rotating the third shaft in a second direction; and the first shaft coupling includes a driving position wherein rotation of the third shaft in the second direction rotates the second shaft to compress refrigerant passing through the reversible turbomachine.

6. The invention as described in claims 1 or 2 wherein:

the power means includes motor means; and the first connecting means further includes a driving position wherein the motor means drives the reversible turbomachine to compress refrigerant passing therethrough.

7. A method of operating a power generation-refrigeration system comprising the steps of:

transferring heat from a source thereof to a refrigerant;

extracting kinetic energy from the heated refrigerant; and selectively producing a refrigeration effect by using the extracted kinetic energy to compress refrigerant, condensing refrigerant, expanding refrigerant to lower the temperature and pressure thereof, and transferring heat from a heat transfer medium to refrigerant to cool the heat transfer medium and evaporate the refrigerant, or generating power by using the extracted kinetic energy to generate power, extracting further kinetic energy from the heated refrigerant, using the further extracted kinetic energy to assist the generation of the power, and condensing the refrigerant.

8. The method of claim 7 wherein:

the step of extracting kinetic energy from the heated refrigerant includes the step of transforming kinetic energy of the refrigerant into rotational energy of a first shaft;

the step of using the extracted kinetic energy to compress evaporated refrigerant includes the steps of passing refrigerant through a reversible turbomachine having a second shaft, and using the rotational energy of the first shaft to rotate the second shaft to compress refrigerant passing through the reversible turbomachine;

the step of extracting further kinetic energy from the heated refrigerant includes the steps of passing refrigerant through the reversible turbomachine, and transforming kinetic energy of refrigerant passing through the reversible turbomachine into rotational energy of the second shaft; and the steps of using the extracted kinetic energy and the further extracted kinetic energy to generate the power include the steps of transferring rotational energy from the first shaft to the second shaft, and transferring rotational energy from the second second to a third shaft, wherein the third shaft is located within an electric generator and rotation of the third shaft generates an electric current.

* * * * *